US005566818A

United States Patent [19]

Kuboyama et al.

[11] Patent Number: 5,566,818

[45] Date of Patent: Oct. 22, 1996

[54] MOVABLE CONTACTOR DEVICE IN CIRCUIT BREAKER

[75] Inventors: Katsunori Kuboyama; Naoshi Uchida, both of Kanagawa, Japan

[73] Assignee: Fuji Electric Co., Ltd., Kanagawa, Japan

[21] Appl. No.: 196,473

[22] Filed: Feb. 15, 1994

[30] Foreign Application Priority Data

Feb. 16, 1993 [JP] Japan ..... 5-050003
Mar. 9, 1993 [JP] Japan ..... 5-075362

[51] Int. Cl.[6] ..... H01H 1/00

[52] U.S. Cl. ..... 200/271; 200/272; 200/273; 200/274; 200/244

[58] Field of Search ..... 200/271, 272, 200/273, 274, 275, 401, 244, 248, 249, 254

[56] References Cited

U.S. PATENT DOCUMENTS 3,137,778 6/1964 Barr ..... 200/254
3,174,024 3/1965 Strother et al. ..... 200/244
4,129,762 12/1978 Bruchet ..... 200/401
4,642,431 2/1987 Tedesco et al. .
4,945,327 7/1990 Doughty et al. .
4,973,927 11/1990 Carothers et al. .
5,004,878 4/1991 Seymour et al. .
5,093,544 3/1992 Lesslie et al. ..... 200/244

FOREIGN PATENT DOCUMENTS 0209056 1/1987 European Pat. Off. .
1640267 11/1967 Germany .
2940781A1 4/1980 Germany .
4-19938 1/1992 Japan .

*Primary Examiner*—David J. Walczak
*Attorney, Agent, or Firm*—Finnegan, Henderson, Farabow, Garrett & Dunner, L.L.P.

[57] ABSTRACT

In a movable contactor device in a circuit breaker, two contactor elements are arranged in such a manner that they are in parallel with each other and are independent of each other, to form a movable contactor for each phase. The two contactor elements have respective movable contacts separated from each other, and are rotatably coupled through a supporting shaft to a connecting conductor having three prong-shaped contact pieces. The number of contact points with the stationary contact can be increased as much.

16 Claims, 4 Drawing Sheets

MOVABLE CONTACTOR DEVICE IN CIRCUIT BREAKER

BACKGROUND OF THE INVENTION

This invention relates to a movable contactor device in a circuit breaker such as a wiring breaker or earth leakage breaker.

Heretofore, in a circuit breaker of this type, a switching movable contactor is, in general, electrically connected through a flexible conductor to a connecting conductor secured to the body casing of the circuit breaker. The flexible conductor is repeatedly bent as the movable contactor operates, and therefore it may be fatigued and broken. Further, a resistance force applied to the movable contactor by the flexible conductor is variable, thus changing the switching characteristic of the circuit breaker. Those difficulties are noticeable especially with a circuit breaker of middle or more size having a flexible conductor large in diameter.

In order to eliminate those difficulties, a movable contactor device which does not have the flexible conductor has been disclosed by Japanese Patent Application (OPI) No. 19938/1992. In the device, a pair of arms are provided at the end portion of the connecting conductor on the stationary side which is connected to the movable contactor, in such a manner that they hold the movable contactor therebetween. The arms are pushed against the side surfaces of the movable contactor with springs, so that the movable contactor is slidably and electrically connected to the connecting conductor. That is, the disclosed device is dispensed with the above-described flexible conductor.

When, with the circuit breaker closed, the movable contact and the stationary contact are completely in parallel with each other horizontally (or in the direction of width), the contact surface of the movable contact which is generally arcuate in a front-to-rear direction is brought in linear contact with the contact surface of the stationary contact which is flat as a whole.

However, because of the assembling error, and depending on the accuracies of the components of the circuit breaker, it is difficult to maintain the movable contact and the stationary contact completely in parallel with each other; that is, those contacts are somewhat inclined in the direction of width. In the above-described slide contact type movable contactor device, the movable contact is greatly restricted with respect to free inclination constructionally because the slide contact portion of the movable contact is pinched by the connecting conductor. That is to say, even though, with the circuit breaker closed, the movable contact is greatly pushed against the stationary contact, the play is less which permits the movable contact to change its posture so as to be sufficiently in contact with the stationary contact. Consequently, a so-called "non-uniform contact" phenomenon occurs; that is, the movable contact is brought into contact with the stationary contact on only one side, right side or left side.

In the case of a small circuit breaker of small rated current, the adverse effects of this non-uniform contact on it are not so serious; however, in the case of a middle or large circuit breaker, the contact resistance generates heat, thus increasing the terminal temperature. With a large circuit breaker whose rated current is for instance 600 A or higher, the current handled thereby is large, and therefore the thickness of the movable contactor and the width of the movable contact welded thereto are more than 10 mm. Accordingly, in the large circuit breaker, it is more difficult to maintain the degree of parallelization of the movable contact and the stationary contract than in a small circuit breaker, and the problem that heat is generated because of the above-described non-uniform contact is more serious.

In view of the foregoing, an object of this invention is to provide a movable contactor device of slide contact type in which the contact area of the movable contact and the stationary contact is increased, and which is applicable particularly to a large circuit breaker.

Beside, the interrupting capacity of a circuit breaker depends on how the stress is reduced which is attributed to the arc energy produced when the current is cut off. Means for reducing the stress is, typically, a current limiting mechanism. The current limiting mechanism operates as follows: When short-circuit current flows in the circuit breaker, the current limiting mechanism quickly moves the movable contactor to open the contact means before the contact opening operation is achieved by the tripping operation of the switching mechanism, so that the arc voltage is increased, and the current limiting interruption is quickly achieved.

The current limiting mechanism performs an unlatching operation by using an electromagnetic repulsion force which is induced by the current which flows in the opposite directions in two conductors arranged in parallel with each other. The above-described current limiting interruption is advantageous in that, at the interruption of short-circuit current, the current peak value and the let-through $I^2t$ value are suppressed, and thermal and mechanical stresses applied to the path of current are greatly reduced.

The key point of the current limiting interruption resides in that the speed of movement of the movable contactor to open the contact means is increased maximum, so that the arc produced in sticking state is quickly made active, to improve the current limiting effect.

On the other hand, in the case where a large circuit breaker is employed to handle large current, the movable contactor is accordingly large in weight, and, when the contact means is opened, the inertial moment of the movable contactor is increased as much, which makes it difficult to increase the speed of movement of the movable contactor to open the contact means.

In view of the foregoing, an object of this invention is to provide a movable contactor device for a circuit breaker in which, at the time of current limiting interruption, the movable contactor is moved at high speed to open the contact means, and which is applicable to a large circuit breaker in which heretofore the in current limiting effect is not so great.

SUMMARY OF THE INVENTION

In order to attain the above-noted and other objects, this invention provides the following new arrangement for a circuit breaker.

To increase the contact area of the movable contact and the stationary contact, two contactor elements made up of flat conductors are arranged in such a manner that the contactor elements are in parallel with each other and are independent of each other, to form a movable contactor for each phase. The two contactor elements have a movable contact made up of two separate parts which are formed on first ends of the two contactor elements, respectively. The remaining second ends of the two contactor elements are rotatably coupled through a current passing pin to a connecting conductor having three prong-shaped contact pieces.

Contact springs are mounted on both end portions of the current passing pin, to slidably push the contactor elements and the contact pieces against one another.

In order to increase the speed of movement of the movable contactor for opening the contact means at the time of current limiting interruption, two contactor elements made up of flat conductors are arranged in such a manner that the contactor elements are in parallel with each other and are independent of each other, to form a movable contactor for each phase, and a current limiting mechanism is provided for each of the contactor elements.

Preferably, a spacing piece is interposed between the two contactor elements which maintains a predetermined space between the contactor elements and allows the contactor elements to move with suitable play to open the circuit breaker.

In the above-noted arrangements, the movable contactor is made up of the two contactor elements, and the latter have the movable contact of the two separate parts which are welded on them, respectively. That is, the movable contact of the movable contact is divided into two parts. Consequently, the number of contact points of the movable contact with the stationary contact is twice as many as that in the case where the movable contact is not divided. Since the movable contact is divided in the above-described manner, the contact characteristic is improved as much, even if it must have a large width as a whole.

Furthermore in the movable contactor device, the two contactor elements are independent of each other. Hence, even when the distance between the movable contact and the stationary contact on the right side is different from that between those contacts on the left side, the right and left contactor elements are movable up and down so that the movable contact divided into two parts is sufficiently in contact with the stationary contact. Thus, in this case, the contact characteristic is higher than in the case where two movable contacts are arranged side by side on an ordinary movable contactor which is a single movable contactor made up of one contactor element.

The movable contactor is in contact with the connecting conductor as follows: The two contactor elements are coupled to the three-prongs-shaped contact pieces of the connecting conductor; that is, one of the contactor elements is held between the central contact piece and the right contact piece and the other is held between the central contact piece and the left contact piece. Hence, in this case, the contact area of the movable contactor and the connecting conductor is twice as large as in the case where a movable contactor made up of one contactor element is held by a fork-shaped (two prongs) connecting conductor.

On the other hand, the two contactor elements made up of flat-plate-shaped conductors are arranged in such a manner that they are in parallel with each other and independent of each other, to form the movable contactor for each phase, and the current limiting mechanism is provided for each of the contactor elements. Thus, the weight per contactor element is halved, and the contactor elements are driven by their own current limiting mechanisms independently of each other, so that, at the time of current limiting interruption, the movable contactor is moved at high speed to open the contact means.

The current flowing in the movable contactor is divided into two parts which flow in the two parallel contactor elements, so that an electromagnetic attraction force acts on the two currents flowing in the same direction. Hence, when a large current such as a short-circuit current flows in the circuit breaker, the contactor elements, being attracted towards each other, may be deformed, or the contacts obtained by halving the movable contact may be welded together being brought into contact with each other.

By inserting the spacing piece between the contactor elements, the latter are prevented from being bent towards each other. In addition, the contactor elements should be coupled through the spacing piece to each other, so that the contactor elements arranged in parallel with each other are operated at the same time to open the contact means. However, in order that, at the time of current limiting interruption, the contactor elements are individually driven by the electromagnetic repulsion force, there is provided a suitable gap (play) between the spacing piece and each of the contactor elements. With this construction, at the time of current limiting interruption, the contactor elements are operated independently of each other during the initial step of opening the contact means in which the movable contactor is initially driven by the electromagnetic repulsion force, and subsequently are operated in association with each other in the contact means opening operation effected after the spring action of the current limiting mechanisms. Thus, the movable contactor has been fully opened.

DETAILED DESCRIPTION OF THE PREFERRED EMBODIMENTS

Preferred embodiments of this invention applied to a three-pole wiring breaker will be described with reference to FIGS. 1 through 9.

Figure 1:
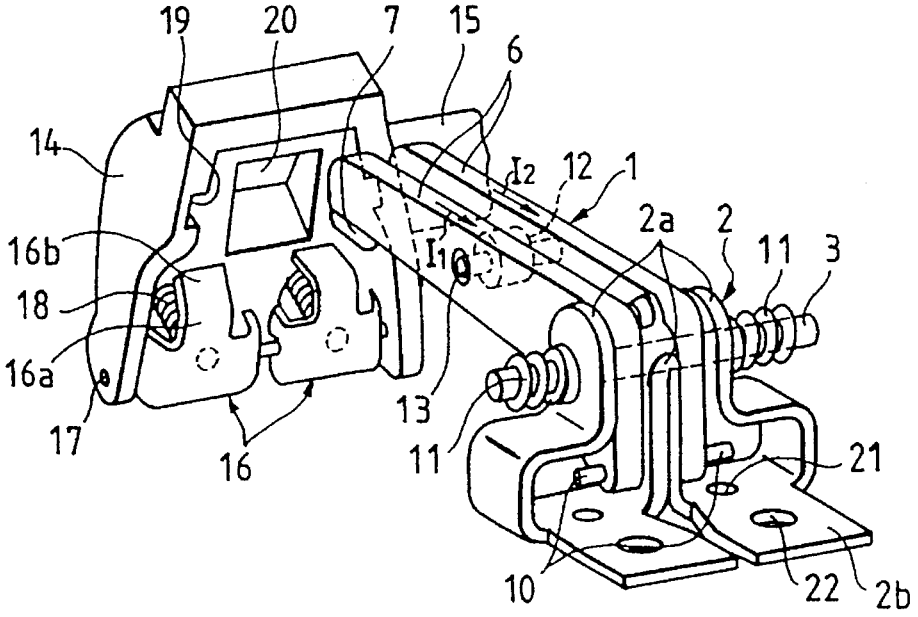
FIG. 1 is an exploded perspective view of a movable contactor device, which constitutes a first embodiment of the invention, showing essential components for each phase.
Figure 2:
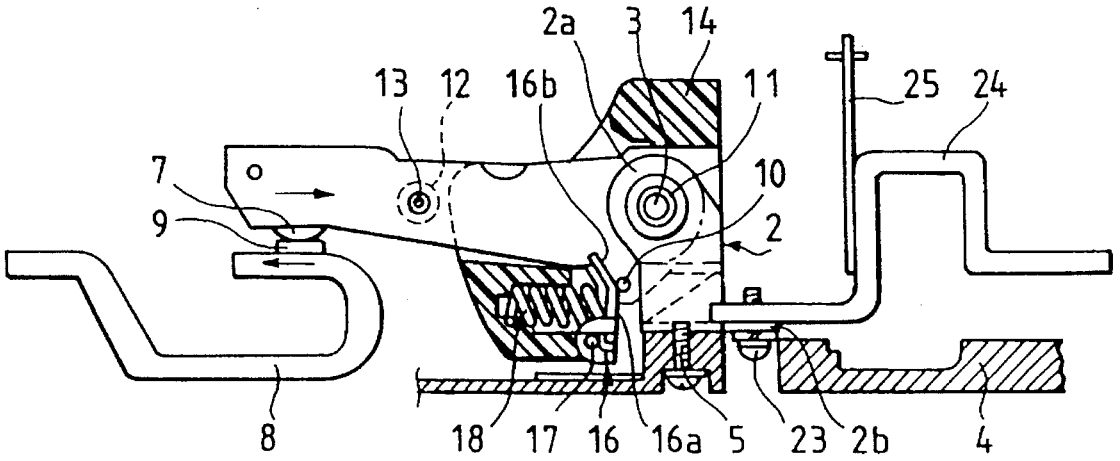
FIG. 2 is a vertical sectional view of the movable contactor device shown in FIG. 1.
Figure 3:
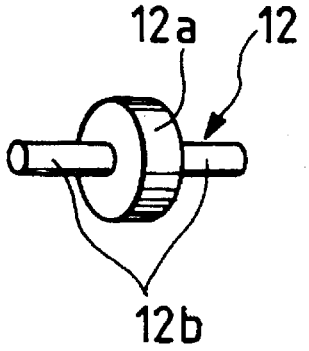
FIG. 3 is a perspective view of a spacing piece shown in FIG. 1.
Figure 4:
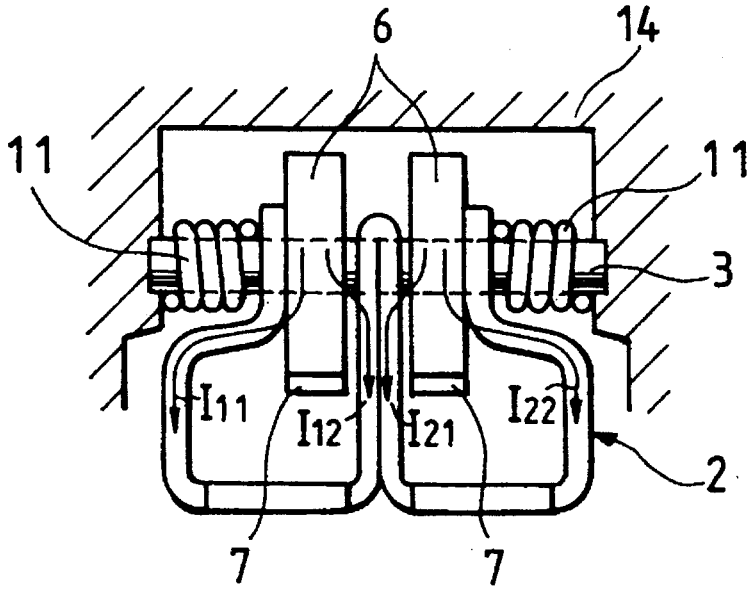
FIG. 4 is a rear view of essential components shown in FIG. 2.

FIG. 1 is an exploded perspective view showing a part of a movable contactor device, a first embodiment of the invention, which corresponds to one of the phases of the circuit breaker; FIG. 2, a sectional view of the same part; FIG. 3, a perspective view of a spacing piece; and FIG. 4 is a rear view of essential components shown in FIG. 2, for a description of the path of current.

As shown in those figures, a movable contactor 1 is swingably coupled to a connecting conductor 2 through a current passing pin 3 supported by the latter 2. The connecting conductor 2 is fixedly secured to a body casing 4 with screws 5.

The movable contactor 1 of each phase is made up of two contactor elements 6, which are formed by punching out a copper plate and arranged in parallel with each other. A movable contact 7 is divided into right and left parts equal in width, which are welded to the end portions of the two contactor elements 6. As best shown in FIG. 2, the contact surfaces of the right and left parts of the movable contact 7 are arcuate; that is, the movable contact 7 is downwardly curved as viewed from side. On the other hand, a stationary contactor 8 is fixedly secured to the body casing 4, and has a stationary contact 9 which is extended over the right and left parts of the movable contact 7. The contact surface of the stationary contact 9 is flat.

The base end portions of the contactor elements 6, which the current passing pin 3 penetrates, have downwardly tapered projections. Current limiting pins 10 (operating as described later) are implanted on the tapered projections of the base end portions of the contactor elements 6 in such a manner that they are extended outwardly.

The connecting conductor 2 is W-shaped, which has three contact pieces **2*a*, and a mounting base 2*b*. More specifically, the connecting conductor 2 is formed by punching out a copper plate and bending it to provide the configuration as shown in FIG. 1. Bearing bosses are formed around the holes of the right and left contact pieces 2*a* by burring into which the current passing pin 3** is inserted.

The movable contactor 1 and the connecting conductor 2 are coupled to each other as follows: One of the two contactor elements 6 is held between the central contact piece **2*a* and the right contact piece 2*a*, and the other contact element 6 is held between the central contact piece 2*a* and the left contact piece 2*a*. The movable contactor 1 and the connecting conductor 2 are pushed against each other by compression springs, namely, contact springs 11 mounted on both end portions of the current passing pin 3**.

The movable connector according to the present invention includes interlocking means for interlocking conductor elements 6 so that the elements 6 rotate together about pin 3. As embodied herein, the interlocking means includes a spacing piece 12, as shown in FIG. 3, set between the right and left contactor elements 6 of the movable contactor 1. The spacing piece 12 includes: a disk **12*a* which is equal in thickness to the central contact piece 2*a* of the connecting conductor 2; and shafts 12*b* extended from both surfaces of the disk 12*a*. The disk 12*a* is held between the confronting surfaces of the contactor elements 6 to determine the space therebetween. The two shafts 12*b* are fitted in bearing holes 13 (FIG. 1) formed in the contactor elements 6. More specifically, the two shafts 12*b* are loosely fitted in the bearing holes 13, so that the contactor elements 6** are vertically movable to some extent with respect to each other.

The base end portion of the movable contactor 1 and the connecting conductor 2 are accommodated in a hollow insulating holder 14 formed as shown in FIG. 1 by molding resin. The insulating holders 14 for the phases are coupled to one another with one opening and closing shaft 15 (FIG. 1); that is, they are swingably supported by the body casing 4 through the opening and closing shaft 15.

Inside the insulating holder, right and left current limiting latches 16 are swingably mounted on one supporting shaft 17. The current limiting latches 16 are formed by punching out a steel plate. Each of the current limit latches 16 comprises: a L-shaped rear wall providing latch surfaces **16*a* and 16*b*; and right and left arms serving as bearing means for the supporting shaft 17. A compression spring 18 is interposed between the insulating holder 14 and the current limiting latch 16, to urge the latter 16 clockwise about the supporting shaft 17 in FIG. 2**.

The movable contactor 1 and the connecting conductor 2, which are coupled to each other through the current passing pin 3, are coupled to the insulating holder as follows: That is, both end portions of the current passing pin 3 are inserted into grooves 19 which are formed in the inner surfaces of the insulating holder 14 as shown in FIG. 1, and the movable contactor 1 is inserted into a window 20 formed in the insulating holder 14, so that the movable contactor 1 and the connecting conductor 2 are coupled to the insulating holder. In this operation, the right and left current limiting pins 10 extended from the contactor elements 6 are pushed against the current limiting surfaces **16*a* of the right and left current limiting latches 16, while compressing the current limiting springs 18. At the same time, the contact springs 11 mounted on the current passing pin 3 are compressed by the inner surfaces of the insulating holder 14**.

As shown in FIG. 2, the insulating holder 14 engaged with the movable contactor 1 is swingably fitted in bearing grooves formed in partition walls (not shown) of the body casing 4, and the connecting conductor 2 is fixedly secured to the body casing 4 with the screws 5 which are screwed into the screw holes 21 in the mounting bases **2*b* from behind the body casing 4. The connecting conductor 2 is connected to a conductor 24 integral with a load terminal with screws 23 inserted into the holes 22 (FIG. 1). An eddy current tripping device is provided on the conductor 24, which comprises: a bimetal plate 25 with the conductor 24 as its heater; and an armature which is attracted by a stationary iron core which surrounds the conductor 24**.

When the circuit breaker is closed as shown in FIG. 2, the insulating holder 14 is held as shown in FIG. 2 by an opening and closing mechanism (not shown), so that the movable contact 7 is pushed against the stationary contact 9. Under this condition, the current limiting springs 18 of the current limiting latches 16 urge the movable contactor 1 counterclockwise through the current limiting pins 10, so that the contacts 7 and 9 are held pushed against each other under a predetermined contact pressure. Each of the current limiting springs is made up of two springs different in winding direction and in diameter which are coaxially combined together. Therefore, the current limiting spring provides a great contact pressure when compared with the one made up of a single spring.

The current limiting pin 10, the current limiting latch 16, and the current limiting spring 18, which are provided for every contactor element 6, form a current limiting mechanism. The current limiting mechanism operates as follows:

In the case of FIG. 2 showing the closure of the circuit breaker, the current limiting spring 18 of the current limiting latch 16 applies a force to the current limiting pin 10 abutting against the latch surface 16a. The line of action of this force is located below the axis of the current passing pin 3 in FIG. 2, and therefore the movable contactor 1 is urged counterclockwise, towards the stationary contactor 8 as was described before.

It is assumed that a large current such as a short-circuit current flows in the circuit breaker. In this case, in the parallel portions of the movable contactor 1 and the stationary contactor 8, the current flows in the opposite directions as indicated by the arrows in FIG. 2, to induce an electromagnetic repulsion force, so that the movable contactor 1 is swung clockwise; that is, the contact 7 leaves the contact 9. When, in this operation, the movable contactor 1 is turned slightly clockwise, the abutting point of the current limiting pin 10 is shifted from the latch surface 16*a* to the latch surface 16*b*, so that the line of action of the force which the current limiting spring 18 applies to the current limiting pin 10 goes above the axis of the current passing pin 3 in FIG. 2.

As a result, the direction of action of the current limiting spring on the movable contactor 1 is changed from counterclockwise to clockwise, so that the movable contactor 1 is driven by both the electromagnetic repulsion force and the force of the current limiting spring 18, to quickly move the contact 7 from the contact 9. Thus, current limiting interruption is carried out before the insulating holder 14 is driven by the opening and closing mechanism which is tripped by the eddy current tripping device.

As was described before, the movable contactor 1 includes the two contactor elements 6 which are independent of each other, and the movable contact 7 is divided into two parts, which are welded to the contactor elements 6, respectively. That is, the number of contact points of the movable contact 7 is twice as many as that of the one which is not divided; and the width of each of the parts of the movable contact 7 is half of that of the movable contact 7. Hence, the movable contact 7 is sufficiently brought into contact with the stationary contact 9, and is increased in contact area. Furthermore even in the case where the movable contactor 1 is shifted laterally as a whole for instance because of an assembling error; that is, in the case where the movable contact 7 and the stationary contact 9 are low in the degree of parallelization, the contactor elements 6 operate independently of each other; that is, they are moved vertically along the stationary contact, so that the right and left parts of the movable contact 7 are positively brought into contact with the stationary contact 9.

Thus, in the case where the right and left parts of the movable contact are brought into contact with the stationary contact, the contact resistance of each of the right and left parts with the stationary contact can be made smaller than that of the single movable contact which is not divided. This will be described with reference to its concrete example.

A single movable contactor with one contact 10 mm×9 mm in horizontal section which had a rated current capacity of 800A was prepared. And a movable contactor according to the invention was prepared which had two silver alloy contacts each being 10 mm×4 mm in horizontal section (half of the contact of the single movable contact). The contact resistances of the single movable contactor and the movable contactor according to the invention were measured under the conditions that the contact pressure was set to 10 kg, and the DC current applied was 100 A. The contact resistance of the former was 46.4 μΩ; whereas the contact resistance of the right part of the movable contactor of the invention was 33.4 μΩ, and that of the left part, 37.7 μΩ.

As shown in FIG. 1, the current I of each phase is divided at the movable contact 7 into currents $I_1$ and $I_2$ which flow in the right and left contactor elements 6 and 6. The currents $I_1$ and $I_2$ are further divided at the contact regions between the contactor elements and the connecting conductor 2 into currents $I_{11}$ and $I_{12}$ currents $I_{21}$ and $I_{22}$, respectively, as shown in FIG. 4. As was described above, in the case of the movable contact divided into two parts, the contact resistance between the contacts 7 and 9 is lower than in the case of the single movable contact which is not divided; however, in the case of the movable contact divided into two parts, the amount of heat generated by the contact region between the movable contact 7 and the stationary contact 9 is represented by the following equation, being half of the amount of heat ($I^2$ R) generated thereby in the case of the single movable contact which is not divided:

$$(I/2)^2 R+(I/2)^2 R=(I^2 R)/2$$

where R is the contact resistance in both cases, and $I_1 \approx I_2 \approx I/2$.

Similarly, if it is assumed that, for simplification in description, the contact resistance between the contactor element 6 and the contact piece 2*a* is represented by r, and $I_{11} \approx I_{12} \approx I_{21} \approx I_{22} \approx I/4$, then the amount of heat generated by the contact region between the movable contact 1 and the connecting conductor is $I^2$ r/4. This value is half of the amount of heat $I^2$ r/2 generated when a movable contactor made up of one contactor element is held with a fork-shaped connecting conductor.

On the other hand, in FIG. 1, an electromagnetic attraction force acts on the currents $I_1$ and $I_2$ which flow in the right and left contactor elements 6 in the same direction. The electromagnetic attraction force tends to bend the contactor elements 6 for instance when a short circuit current flows therein; however, in the embodiment, this difficulty is eliminated by the insertion of the spacing piece 12 between the contactor elements 6. That is, the spacing piece 12 prevents the contactor elements 6 from approaching each other. More specifically, the provision of the spacing piece 12 eliminates difficulties that the contactor elements 6 are deformed, and the right and left parts of the movable contact 7 are prevented from contacting each other, thus being welded together.

The movable contactor 1 of each phase is made up of two contactor elements 6. Those contactor elements 6 are driven by the electromagnetic repulsion force independently of each other in the gaps between the shafts 12*b* of the spacing piece 12 and the bearing holes 13, and then driven to the full open position at high speed by the current limiting springs 18.

As was described above, the movable contactor 1 is made up of the two contactor elements. The weight of each of the contactor elements on which the electromagnetic repulsion force and the current limiting spring force act is a half of the weight of an ordinary movable contactor which is made up of one conductor, and therefore the inertial moment is reduced as much, and the opening speed of the movable contactor 1 is increased as much. As a result, even in a large circuit breaker, the period of time (or arc sticking time) which lapses from the time instant that the electromagnetic repulsion force is applied to the movable contactor 1 until the current limiting mechanism starts its operation, and the period of time (or arc voltage rising time) which lapses from the time instant that the movable contactor 1 is fully opened until an arc rises actively, can be reduced to those in a small circuit breaker.

Figure 5:
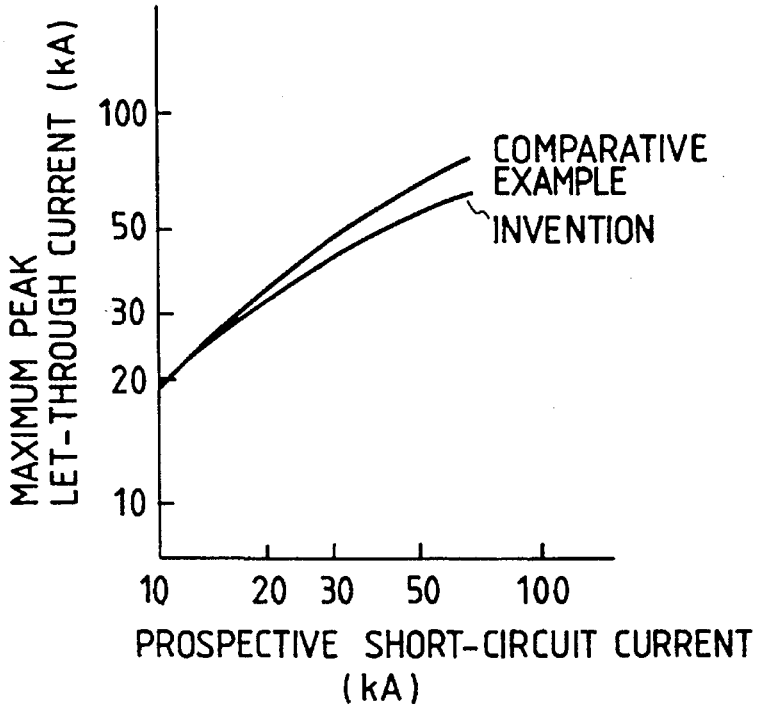
FIG. 5 is a graphical representation indicating relationships between prospective short-circuit current and maximum peak let-through current in a circuit breaker with the movable contactor device shown in FIG. 1, for comparison with those in a conventional circuit breaker.
Figure 6:
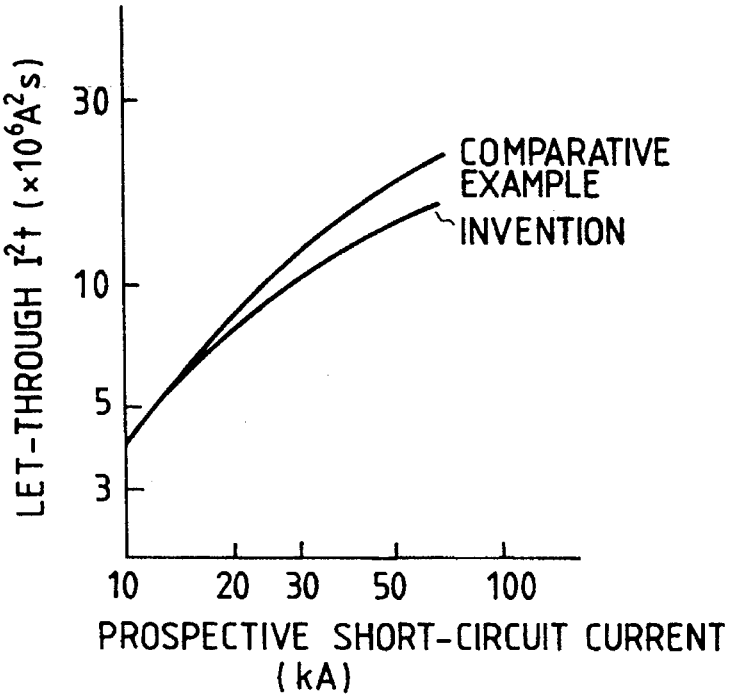
FIG. 6 is a graphical representation indicating relationships between prospective short-circuit current and let-through $I^2t$ in a circuit breaker with the movable contactor device shown in FIG. 1, for comparison with those in a conventional circuit breaker.

FIGS. 5 and 6 indicates examples of the measurements of maximum peak let-through current value and let-through $I^2t$ value of a 800 A circuit breaker at the time of interruption with 460 V and 65 kA, for comparison of the circuit breaker with the movable contactor according to the invention with the conventional circuit breaker. As is apparent from those figures, the circuit breaker of the invention is greatly reduced in maximum peak let-through current value and in let-through $I^2t$ value, and the thermal and mechanical effects on the casing and the cover are suppressed accordingly.

In order to improve the current limiting interruption only, it is not always necessary that the electrical connection of the movable contactor 1 to the connecting conductor on the stationary side is made through slide contact as in the embodiment; that is, the connection may be achieved with a flexible conductor as in the prior art.

Figure 7:
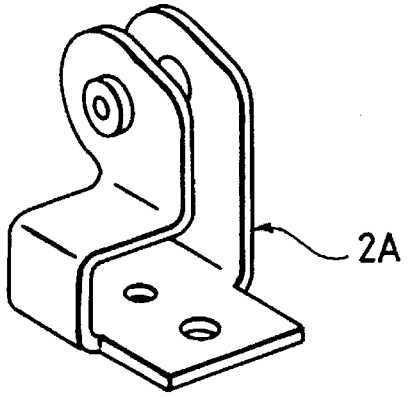
FIG. 7 is a perspective view showing one modification of a connecting conductor shown in FIG. 1.
Figure 8:
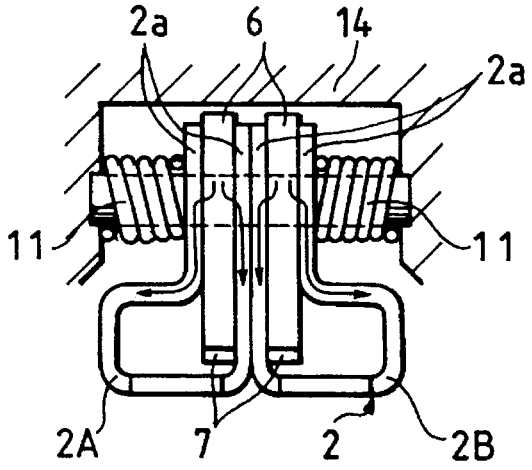
FIG. 8 is a rear view showing essential components of the movable contactor device with the connecting conductors shown in FIG. 7.

FIGS. 7 and 8 show one modification of the connecting conductor 2, which is made up of right and left parts which are symmetrical with each other. More specifically, FIG. 7 is a perspective view of one of the two parts forming the connecting conductor, and FIG. 8 is a rear view of the connecting conductor 2 which is coupled to the movable contactor 1. In the embodiment shown in FIG. 1, the connecting conductor 2 is formed by bending one plate punched out. In the modification, a pair of fork-shaped conductors 2A and 2B, which are symmetrical in configuration with each other, are abutted against each other, to form the connecting conductor 2 which is W-shaped as a whole having the right and left contact pieces and the central contact piece. More specifically, after the right and left contactor elements 6 and 6 are held in the right and left fork-shaped conductors 2A and 2B, respectively, the latter 2A and 2B are set abutted against each other.

The connecting conductor shown in FIGS. 7 and 8 can be readily formed on a press machine when compared with the one shown in FIG. 1 of which all the parts inclusive the central contact piece are formed as one unit. Therefore, the connecting conductor is lower in manufacturing cost.

Figure 9:
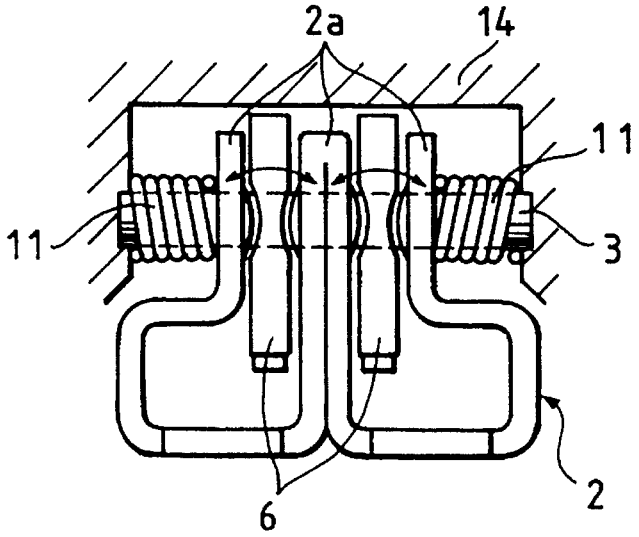
FIG. 9 is a rear view showing essential components of a second embodiment of the invention, in which the movable contactor and the connecting conductor are different from those in the first embodiment of the invention.

FIG. 9 is a rear view showing essential components of a second embodiment of the invention, in which the contacting parts of the movable contactor 1 and the connecting conductor 2 are made spherical. That is, in the second embodiment, spherical protrusions are formed on the contact pieces **2*a* of the connecting conductor 2, while spherical recesses are formed in the contactor elements 6 which are slightly larger in the radius of curvature than the spherical protrusions. Those spherical protrusions and spherical recesses are engaged with each other as shown in FIG. 9, and slidably pushed against each other by the contact springs 11. In this case, there are provided suitable gaps between the current passing pin 3 and the holes in the contactor elements 6 into which the former 3** is inserted.

In the second embodiment thus constructed, the contactor elements 6 can be turned with respect to the connecting conductor 2 as indicated by the arrows in FIG. 9, and therefore the connecting conductor is less restrained when the contactor elements 6 incline right and left. Hence, in the case where the movable contact 7 and the stationary contact are low in the degree of parallelization in the horizontal direction as was described before, the contactor elements 6 can be readily inclined to the right or left according to the stationary contact 9 until the movable contact 7 is sufficiently brought into contact with the stationary contact 9.

As was described above, in the movable contactor device of the invention, the movable contactor is made up of two contactor elements, and the movable contact is divided into two parts, which are welded on the two contactor elements, respectively. Hence, in this case, the number of contact points with the stationary contact is twice as many as in the case where an ordinary movable contactor made up of a single contactor element is employed. The movable contact is divided into two parts, as was described above. Therefore, even if the movable contact is large in area and accordingly large in width, the two parts are each smaller in width, which improves the contact characteristic of the movable contact. Furthermore, the right and left contact elements are operable independently of each other. Therefore, even when the distance between the movable contact and the stationary contact on the right side is different from that between those contacts on the left side, the right and left contactor elements are movable up and down so that the movable contact divided into the two parts is sufficiently in contact with the stationary contact, which further improves the contact characteristic.

Accordingly, in the case where, because of the assembling error and depending on the accuracies of the components of the circuit breaker, the movable contact and the stationary contact are low in the degree of parallelization in the right-to-left direction, or even in the case where the contact surface of the stationary contact is inflated or deflated by being thermally damaged after the overload current tripping operation, the movable contact is brought into uniform contact with the stationary contact with ease, increasing the contact area, and the amount of heat generated thereby is decreased.

Furthermore, in the movable contactor device of the invention, the movable contactor is slidably coupled to the connecting conductor having the contact pieces like three prongs; more specifically, one of the contactor elements forming the movable contactor is held between the central contact piece and the right contact piece, and the other is held between the central contact piece and the left contact piece. Hence, in this case, the contact area is twice as large as in the case where a connecting conductor having only one contact piece is held between two contact elements or a movable contactor made up of only one contactor element is held by two contact pieces like two prongs. Thus, the movable contact and the connecting conductor, which are held slidably in contact with each other, may have a sufficiently large current capacity.

Moreover, in the movable contactor device of the invention, the two contactor elements made of flat-plate-shaped conductors are arranged in such a manner that they are in parallel with each other and are independent of each other, to form the movable contactor for each phase, and the current limiting mechanism is provided for each of the contactor elements. Hence, the mass to be driven by the electromagnetic repulsion force and the current limiting spring force at the time of current limiting interruption is halved. Therefore, even with a large capacity circuit breaker in which heretofore the current limiting effect is not so great, the speed of movement of the movable contactor for opening the contact means is increased with ease, and the arc power is greatly reduced.

In addition, in the movable contactor device of the invention, the spacing piece is interposed between the two contactor elements which regulates the distance between the contactor elements and causes the contactor elements to move, with suitable play, in association with each other to open the contact means. Hence, even when a large current flows in the circuit breaker, the latter is free from difficulties that the contactor elements are deformed by the electromagnetic attraction force, and the two parts obtained by dividing the movable contact are welded together. And the two contactor elements can be operated in association with each other without affecting their independent operations during the initial step of opening the contact means at the time of current limiting interruption.

What is claimed is:

1. A movable contactor device in a circuit breaker, comprising:

two contactor elements made up of plate-like conductors, arranged in such a manner that said contactor elements are in parallel with each other and are movable independent of each other, for forming a movable contactor;

a movable contact made up of two separate parts which are respectively formed on first ends of said two contactor elements;

a current passing pin for rotatably coupling second ends of said two contactor elements to a connecting conductor, wherein said second ends are located opposite from said first ends; and a pair of contact springs mounted on both end portions of said current passing pin, for pushing said contactor elements and said connecting conductor against one another while permitting a slidable rotation therebetween.

2. The movable contactor device as claimed in claim 1, further comprising a spacing piece interposed between said two contactor elements for maintaining a predetermined space between said contactor elements, and coupling said contactor elements to each other with suitable play, said play permitting one of said contactor elements to independently rotate relative to the other.

3. The movable contactor device as claimed in claim 1, further comprising:

means for permitting each of said contactor elements to incline with respect to a plane orthogonal to an axis of said current passing pin.

4. The movable contactor device as claimed in claim 1, further comprising interlocking means for interlocking said contactor elements to rotate together about said current passing pin, wherein said interlocking means permits a slight relative rotation between said contactor elements.

5. The movable contactor device as claimed in claim 4, wherein said interlocking means includes a pair of bearing holes respectively formed through said contactor elements and extending substantially coaxially with respect to each other, and a shaft loosely fitted in both said bearing holes.

6. A movable contactor device in a circuit breaker, comprising:

two contactor elements made up of flat conductors, arranged in such a manner that said contactor elements are in parallel with each other and are independently movable with respect to each other, to form a movable contactor; and two current limiting mechanisms wherein each current limiting mechanism corresponds to a respective contactor element for independently applying a mechanical force to move said corresponding contactor element in cooperation with an electromagnetic repulsion force at times when an overload current flows in said corresponding contactor element.

7. The movable contactor device as claimed in claim 6, further comprising:

a spacing piece interposed between said two contactor elements for maintaining a predetermined space between said contactor elements and kinematically coupling said contactor elements.

8. The movable contactor device as claimed in claim 6, further comprising:

interlocking means for interlocking said contactor elements to move together, wherein said interlocking means permits a slight relative movement between said contactor elements.

9. A movable contactor device in a circuit breaker, comprising:

two contactor elements made up of flat conductors, arranged in such a manner that said contactor elements are in parallel with each other and are independently movable with respect to each other, to form a movable contactor;

two current limiting mechanisms wherein each current limiting mechanism corresponds to a respective contactor element for applying a mechanical force to move said corresponding contactor element in cooperation with an electromagnetic repulsion force at times when an overload current flows in said corresponding contactor element; and interlocking means for interlocking said contactor elements to move together, wherein said interlocking means permits a slight relative movement between said contactor elements and includes a pair of bearing holes respectively formed through said contactor elements and extending substantially coaxially with respect to each other, and a shaft loosely fitted in both said bearing holes.

10. A movable contactor device in a circuit breaker, comprising:

two contactor elements made up of plate-like conductors, arranged in such a manner that said contactor elements are in parallel with each other and are movable independent of each other, for forming a movable contactor;

a movable contact made up of two separate parts which are respectively formed on first ends of said two contactor elements;

a current passing pin for rotatably coupling second ends of said two contactor elements to a connecting conductor so that said contactor elements are independently rotatable with respect to each other, wherein said second ends are located opposite from said first ends; and interlocking means for interlocking said contactor elements to rotate together about said current passing pin, wherein said interlocking means permits a slight relative rotation between said contactor elements.

11. The movable contactor device as claimed in claim 10, wherein said interlocking means includes a pair of bearing holes respectively formed through said contactor elements and extending substantially coaxially with respect to each other, and a shaft loosely fitted in both said bearing holes.

12. A movable contactor device in a circuit breaker, comprising:

two contactor elements made up of flat conductors, arranged in such a manner that said contactor elements are in parallel with each other and are independently movable with respect to each other, to form a movable contactor; and two current limiting mechanisms wherein each current limiting mechanism corresponds to a respective contactor element for applying a mechanical force to move said corresponding contactor element in cooperation with an electromagnetic repulsion force at times when an overload current flows in said corresponding contactor element, wherein each current limiting mechanism includes a pin extending from said corresponding contactor element, a rotatable latch abutting said pin, and a spring for applying the mechanical force to said latch and said pin to move said contractor element.

13. The movable contactor device as claimed in claim 1, wherein said connecting conductor includes three prong-shaped contact pieces adjacent to and alternating with the second ends of the two contactor elements, the contact springs pushing the second ends and the contact pieces together.

14. A movable contactor device in a circuit breaker, comprising:

first and second contactor elements arranged in such a manner that said contactor elements are in parallel with each other and are independently movable with respect to each other, to form a movable contactor; and a current limiting mechanism for independently applying a first mechanical force to move said first contactor element in cooperation with a first electromagnetic repulsion force when a first overload current flows in said first contactor element and a second mechanical force to move said second contactor element in cooperation with a second electromagnetic force when a second overload current flows in said second contactor element.

15. The movable contactor device as claimed in claim 14, further comprising:

a spacing piece interposed between said first and second contactor elements for maintaining a predetermined space between said contactor elements and kinematically coupling said contactor elements.

16. The movable contactor device as claimed in claim 14, further comprising:

interlocking means for interlocking said first and second contactor elements to move together, wherein said interlocking means permits a slight relative movement between said first and second contactor elements.

* * * * *